United States Patent [19]

Chau-Pin

[11] Patent Number: 4,722,537

[45] Date of Patent: Feb. 2, 1988

[54] KNOCKDOWN TOY HORSE

[76] Inventor: Hsu Chau-Pin, Rm #6A-1, 12. 5, Hsin-Yi Rd., Sec. 5, Taipei, Taiwan

[21] Appl. No.: 880,299

[22] Filed: Jun. 30, 1986

[51] Int. Cl.[4] ..... A63H 7/00; A63G 13/06

[52] U.S. Cl. ..... 280/1.13; 272/52.5; 280/1.188; 280/1.22; 280/9; 280/287; 446/114

[58] Field of Search ..... 280/1.1 R, 1.11 R, 1.13, 280/1.201, 7.1, 287, 30, 1.193, 7.12, 7.15, 7.17, 9, 1.188, 1.189; 446/114, 108; 272/52, 52.5

[56] References Cited

U.S. PATENT DOCUMENTS 256,390 4/1882 Shepardson ..... 272/52.5

295,457 3/1884 Steinbach ..... 272/52.5

2,551,071 5/1951 Tyng ..... 272/52.5

*Primary Examiner*—John J. Love

*Assistant Examiner*—Everett G. Diederiks, Jr.

*Attorney, Agent, or Firm*—Asian Pacific International Patent and Trademark Office

[57] ABSTRACT

The toy horse is characterized by a rigid structure assembled of components with appropriate tenons and mortises. The structure can facilitate shipment and storage. Erection and dismantling of it can provide interllectual training to children and educate them with basic concepts of organization and structure. It further incorporates casters kept in the bottoms of supporters and which can be extended to contact with the ground to provide a mobile toy.

1 Claim, 8 Drawing Figures

KNOCKDOWN TOY HORSE

BACKGROUND OF THE INVENTION

The conventional toy horses are generally of fixed design, made of wood in large volumes, and storage and carriage thereof is not convenient, shipment requires large shipping space too. Deterioration of paint would detrimentally impact appearance. Their production cost is high and production speed is low. They are not generally acceptable.

SUMMARY OF THE INVENTION

A toy is not only intended for fun and entertainment, but also for education and family unity and tranquility. Therefore, in view of the defects of the conventional toy horse, the invention provides the following characteristics:

The main objective of present invention is to provide a knockdown toy horse which is useful to train intelligence, and further education and family unity.

Another objective of the present invention is to provide a decoloration-proof, washable, durable and appealing knockdown toy horse.

Another objective of the present invention is to provide a rocking toy horse which can be pushed, or pulled and can be used as a chair to feed a child. Another objective of the present invention is to provide a knockdown toy horse which allows a high production speed, low production cost, is easily assembled and disassembled, and is compact for shipment.

Another objective of the present invention is to provide a knockdown toy horse which is easy to erect and knock down as well as being easy to store and carry.

DETAILED DESCRIPTION

Figure 1:
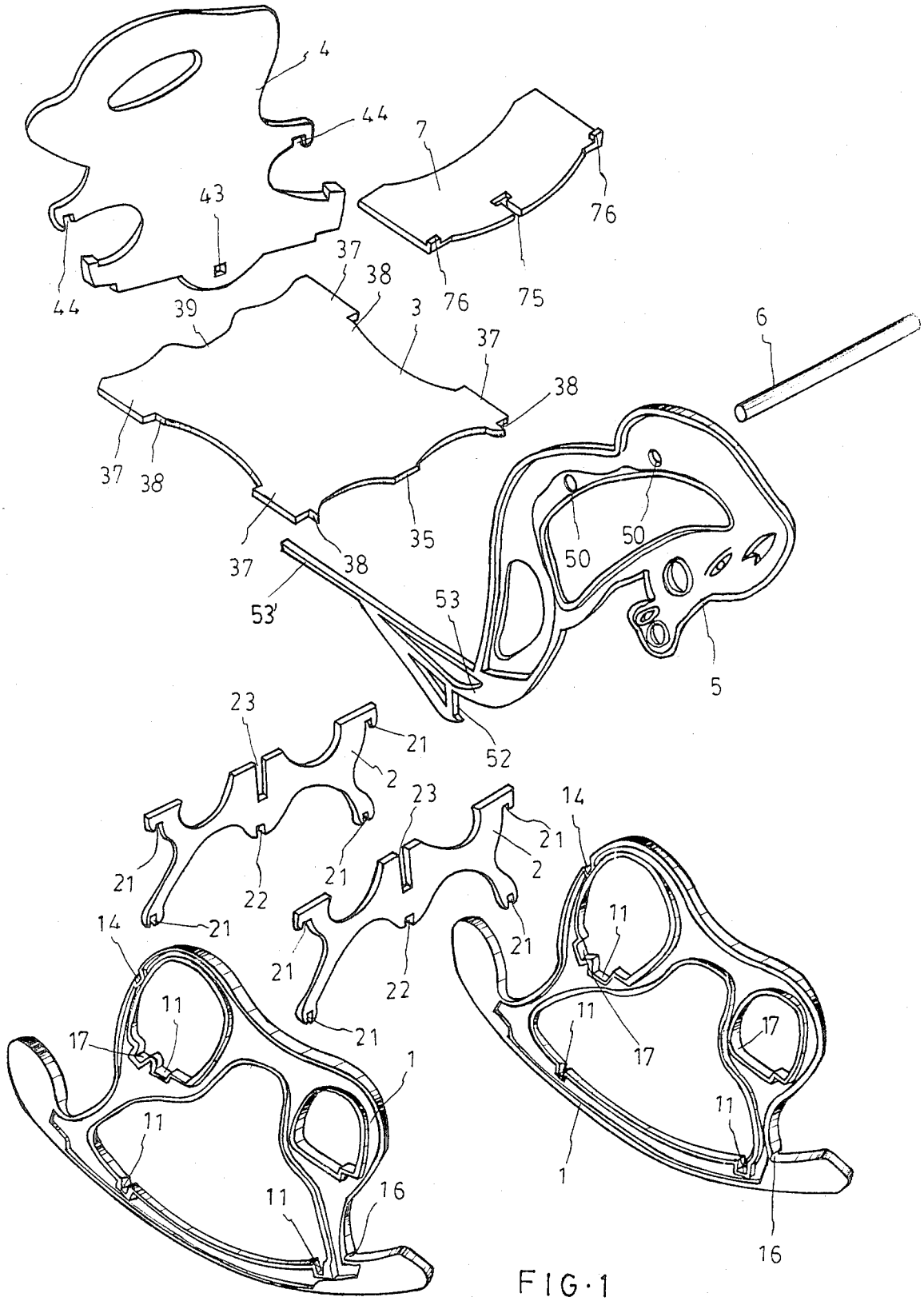
FIG. 1 illustrate components of the present invention in an exploded view.
Figure 2:
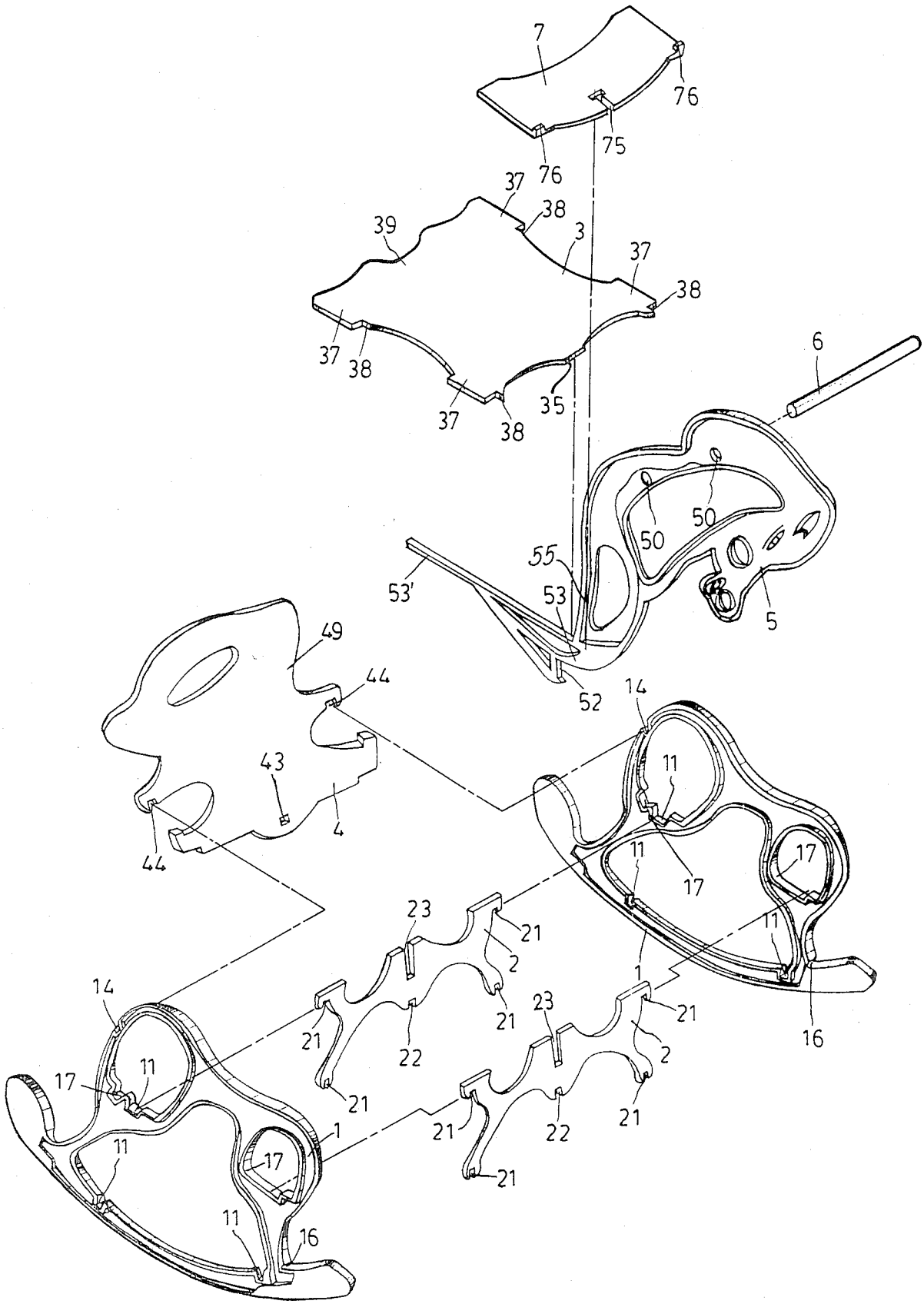
FIG. 2 is a perspective and fragmental view illustrating knockdown of the present invention.
Figure 8:
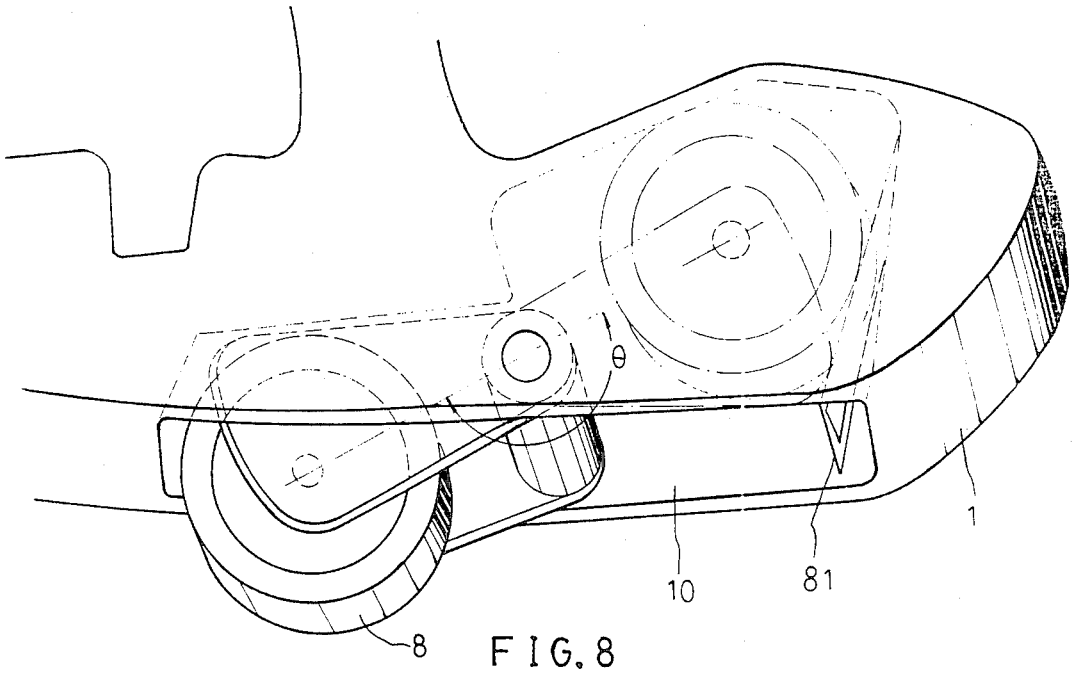
FIG. 8 illustrates the structure of a caster according to the present invention.
Figure 7:
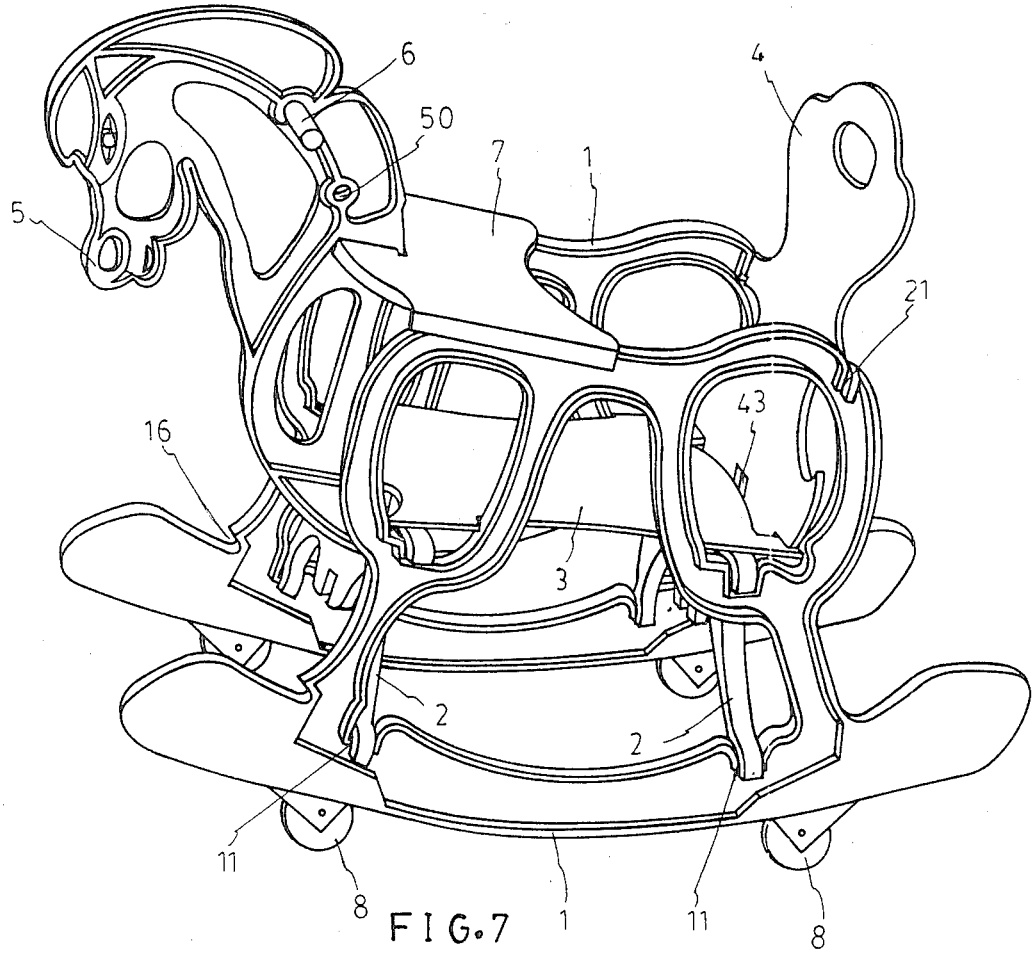
FIG. 7 is a perspective view of the embodiment according to the present invention with the casters in the extended position.

Please refer to FIGS. 1 and 2 which illustrate the structure of an embodiment of the present invention. The embodiment comprises:

Two supporters 1, each of which is a board with a bottom wider than its top, a hollowed left and right corners and hollowed middle for the purpose of reducing weight and saving material, a plurality of square slot mortises 11 along the curvy side of the hollowed middle and straight bottom sides of the hollowed left and right corners, corresponding to a plurality of square slot mortises 21 along the lateral sides of connecting boards 2 for cross conjunctions. A mortise 17 is provided at the lower edge of each of the right and left hollowed corners for respective tenons 37 at the sides of and seat 3, a square slot mortises 14 are provided at an appropriate position on the rear side for square slot mortises 44 on the lateral sides of a back plate 4 for cross conjunction. A further slot mortise 16 on the front lower corner serves to cooperate with the front edge 76 of a step board 7 when necessary curvy lower edge with appropriate forward and backward extensions for maintaining stable rocking and precluding instability when the embodiment is rocking. There are two holes 10 at appropriate positions, one near the front side and other other near the rear side of the lower edge of each curvey leg for the installation of casters 8 and the extension to contact the ground by these is controlled by leaf springs 81, please refer to FIGS. 7 and 8.

The two connecting boards 2, each of which is a board having the general shape of the letter "M", with a flat upper edge to support the seat 3, a square slot mortise 21 at each of the lower corners corresponding to the slot mortise 11 at a supporter 1 for cross conjunction, and with two slot mortises 23 and 22, one on the top and the other on the bottom of its middle for connecting to the lower front tenons 53 and 42 of a head board 5.

The head board 5, with the front part made in the shape of an animal, has a hole 5, for a handle 6 which handle can be held when the embodiment is rocking, at a position near the middle point of the head, two tenons 53 and 52 at the lower front side corresponding to two slot mortises 23 and 22 of the connecting boards 2. The head board 5 also has a square tenon 53' at the back corresponding to a mortise 43, at the lower side of the back plate 4 and having a flat upper side to support the middle part of the seat 3, a T-edge 55 at the back side corresponding to a T-slot 75 of the step board 7, and has a flat back side for connecting it to the front side 35 of the seat 3.

The seat 3 is a board having a plurality of tenons 37 corresponding to the mortises 17 of the supporters 1, recessed vertical surfaces 38 at two lateral sides to contact with respective surfaces of the supporters 1, a flat edge 39 on the back to contact with the lower surface 49 of the back plate 4, and a flat edge 35 on the front side to contact with the T-edge 55 on the back of the head board 5. The seat 3 is supported by the top side of the square tenon 531 extending from the head board 5 and the flat upper edges of the connecting boards 2.

The back plate 4 is a board which has square slot mortise 44 at the middle of each lateral side corresponding to the slot mortises 14 on the upper back corners of the supporters 1 for cross conjunction, a square slot mortise 14 at the middle of the lower edge for connecting of the square tenon 53' extending from the head board 5, and a flat lower edge 49 to contact with the flat back edge 39 of the seat 3.

A step board 7 in the form of a board has a T-slot 75 at the middle of the front edge for connecting to the T-edge 55 at the back of the head board 5. The step board 7 is supported by the upper edges of the supporters 1 to form a table surface, or, if necessary, it has two blocks at two lateral sides of the front edge connected to the slot mortises 16 at the lower corners of the supporters 1 to form a step board.

A handle 6 in the form of a round bar can be inserted through the hole 60 at the middle of the head board 5 for being held by a child riding the toy horse.

Figure 3:
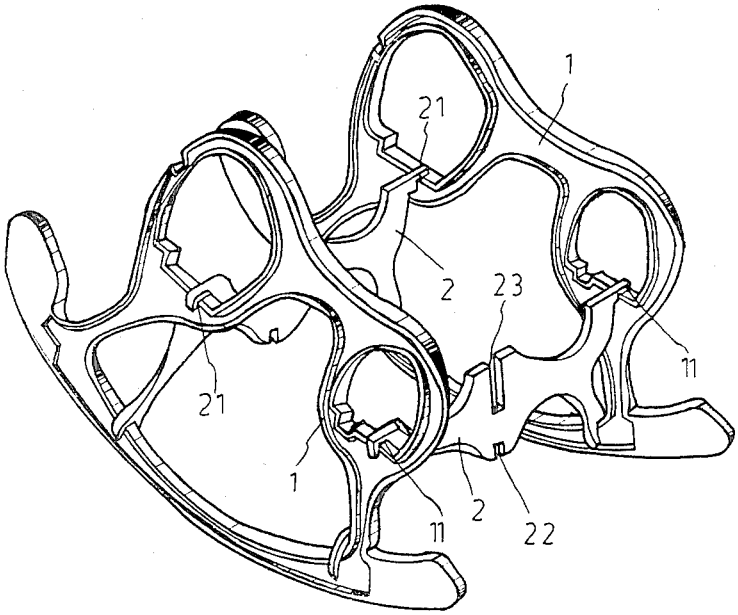
FIG. 3 shows erection procedure 1 of the present invention.

Normally, the embodiment is kepted disassembled to facilitate storage or shipment. For use, it is erected in accordance with the following procedure:

1. Please refer to FIGS. 2 and 3, each mortise 11 at the supporters 1 and its corresponding mortise 21 at the connecting boards 2 are connected together by cross conjunction to form a strong basic structure.

Figure 4:
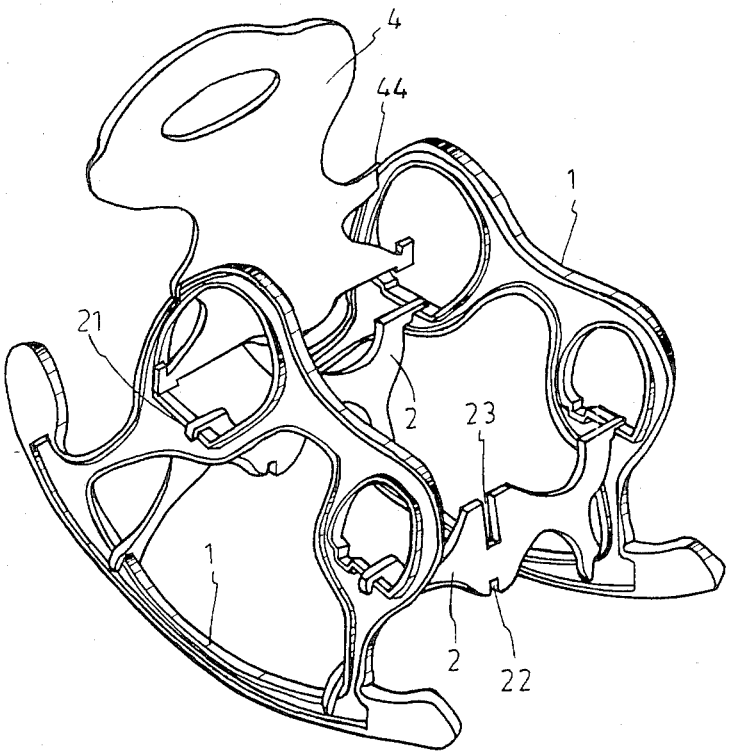
FIG. 4 shows erection procedure 2 of the present invention.

2. Please refer to FIG. 4, each mortise 44 at the back plate 4 and its corresponding mortise 14 at the upper eder of the back of the supporters 1 are connected together by cross conjunction.

Figure 5:
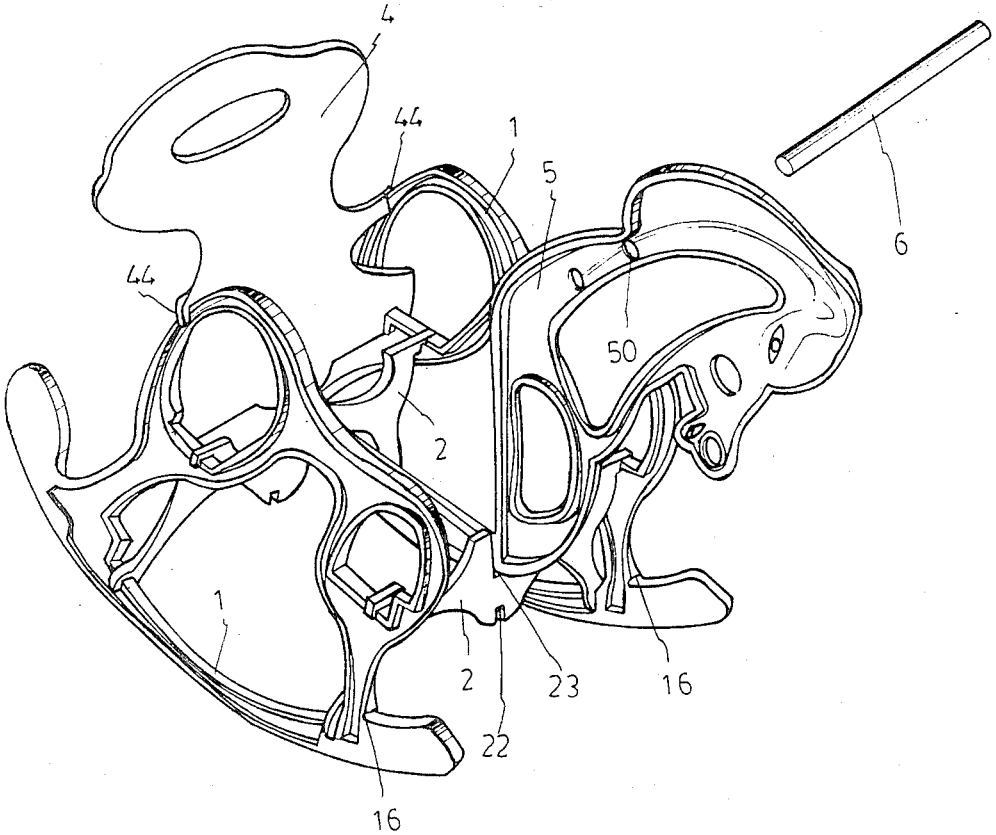
FIG. 5 shows erection procedure 3 of the present invention.

3. Please refer to FIG. 5, tenon 53' extending from the head board 5 is inserted to the mortise 43 at the back plate 4 and the mortise 23 in the middle of the upper part of the conecting plate 2, and then the head board 5 is pushed forward so that tenons 53 and 52 the lower front side of the head board 5 are inserted into the mortises 23 and 22 of the connecting plate 2 respectively. The handle 6 is then inserted through the hole 50 of the head board 5.

Figure 6:
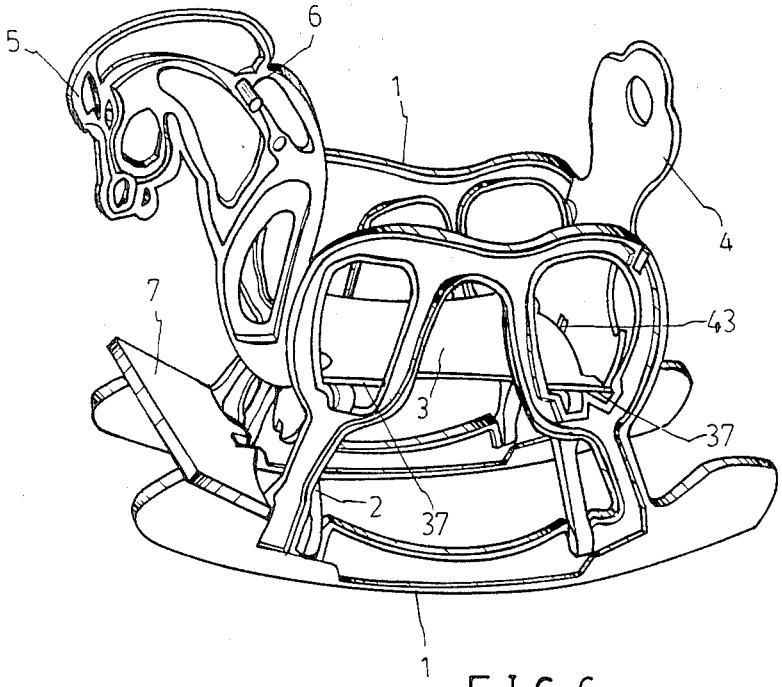
FIG. 6 is a first perspective view of an embodiment according to the present invention.

4. Please refer to FIG. 6, long tenon 37 at each lateral side of the seat 3 is inserted into the corresponding mortise 17 at the upper edge of the supporters 1, both left and right straight sides 38 are placed to keep contact with respective inner surfaces of the supports 1, the flat front edge 35 is placed to keep close contact with the back edge of the T-edge 55 of the head board 5, and the flat back edge 39 is placed to keep close contact with the lower surface 49 of the back plate 4. The bottom of seat 3 is supported by the flat upper side of the connecting boards 2 and the flat upper side of the tenon extending from the head board 5 to form a rigid structure.

5. Please refer to FIG. 7, blocks 76 at the left and right sides of the step board 7 are fixed to the respective mortises 16 at the lower corners of the supporters 1 to complete the erection, or, if necessary, the T slot 75 at the middle of the front side of the step board 7 is fixed to the T-edge 55 at the back side of the head board 5 with two ends placed on the supporters 1 to form a table surface.

6. Please refer to FIGS. 7 and 8, casters 8 within the recesses 10 of the supporters 1 are extended to contact with the ground to form a wheeled toy, or they can be retracted to from a rocking toy horse with curvy bottom.

7. The embodiment can be dismantled in the reverse order of the above procedure.

As described above, erection and dismantling of the present invention is very easy. Because a certain procedure must be followed, erection and dismantling are meaningful from the view point of education and intellectual training. Parents may aid their children and compete with them for erection in order to promote family unity.

In conclusion, by adults, the present invention can be erected and disassembled very easily. Storage and carriage is convenient. It can be knocked down for shipment and the required shipping space and freight costs can be reduced, its capability in international market competition is improved. For children, erection and disassembly of the present invention are not easy. Parents may aid and instruct children with the correct procedure of erection and disassembly in the course. Therefore, the present invention is an intellectual toy, and parents can become aware of their children's relative intelligence based on the time spent in erection and disassembly of the toy. Children could get an understanding of structure in the course of building and disassembly. Therefore, the present invention is an educational toy. Assistance and comments for erection and disassembly of the toy are a presentation of love from parents. Therefore, the present invention could help family unity. The present invention can be produced rapidly by plastic moulds with low production cost and sharp colors. It is washable and durable. As for its strength, the thickness of each component can be determined by experiments, and its edges can be made round to avoid accident. Therefore, the present invention is a substantially absolutely safe toy. The horse-shaped head board 5 may be replaced by a board of any other like shape.

I claim:

1. A knockdown toy comprising:

two supporters, each of which is a board with a bottom wider than its top, a hollowed middle with a curvy side, hollowed left and right corners for reducing weight and saving material, a plurality of square slot mortises along the curvy side of said hollowed middle and straight bottom sides of the hollowed left and right corners, corresponding to a plurality of square slot mortises along lateral sides of respective connecting boards for cross conjunctions, a mortise at lower edges of each of the right and left hollowed corners, corresponding to a tenon at a side of a respective seat, a square slot mortise at each rear side, corresponding to a square slot mortise on a lateral side of a respective back plate for cross conjunction, a slot mortise at their front lower corners for supporting a front edge of a respective step board, said curvy lower edge having forward and backward extensions for maintaining center of gravity, permitting rocking motions, but precluding over-turning when the toy is rocking, and said curvy lower edge having two holes, one near the front side and the other near the rear side of the lower edge for the installation of respective casters, extension of which to contact with ground is controlled by respective leaf springs;

two M-shaped connecting boards, each with a flat upper edge to support the respective seat, a square slot mortise at each of their lower corners, corresponding to a slot mortise at a respective supporter for cross conjunction, two slot mortises, one upper and one lower, for connecting to lower front tenons of a respective head board;

a head board, with the front part made in the shape of a horse and the like animal, said head board having a hole for a respective handle to be held when the toy is rocking, said hole being positioned near the central point of the head board, two tenons at its lower front side, corresponding to two slot mortises of the connecting boards, a square tenon at its back, corresponding to a mortise at a lower side of a respective back plate and having a flat upper side to support a central part of the respective seat, a T-edge at its back side corresponding to a T-slot of the respective step board and having a flat back side for connecting to a front side of the respective seat;

a seat which is a board having a plurality of tenons corresponding to the mortises of the supporters, recessed vertical surfaces at two lateral sides to contact with respective surfaces of the supporters, a flat edge on the back to contact with a lower surface of the respective back plate, a flat edge on its front side to contact with the flat back edge of said T-edge on the back of said head board, and supported by the top side of the square tenon extending from the head board and the flat upper edges of the connecting boards;

a back plate in the form of a board, said back plate having a square slot mortise at the middle of each lateral side, corresponding to the slot mortises on the upper back corners of the supporters for cross conjunction, a square slot mortise at the middle of the lower edge for connecting of the square tenon extending from the head board, and a flat lower edge to contact with the flat back edge of the seat;

a step board in the form of a board, said step board having a T-shaped slot at the middle of its front edge for connecting to the T-edge at the back of said head board, supported by the upper edges of the supporters to form a table surface, and having two blocks at two lateral sides of the front edge connected to the slot mortises at the lower corners of the supporters;

a handle in the form of a round bar adapted to be inserted through said hole of said head board for holding by a child rocking the toy;

at least two retractable casters for each supporter; and leaf springs for controlling retraction and extension of said casters.

* * * * *